United States Patent [19]

Rico

[11] Patent Number: 4,550,440

[45] Date of Patent: Oct. 29, 1985

[54] ARTICLE RECEPTACLE

[76] Inventor: Ezequiel Rico, 1409 Florida Pl., Anaheim, Calif. 92805

[21] Appl. No.: 523,342

[22] Filed: Aug. 15, 1983

Related U.S. Application Data

[62] Division of Ser. No. 170,188, Jul. 18, 1980, Pat. No. 4,411,300.

[51] Int. Cl.[4] ..... B65D 33/14

[52] U.S. Cl. ..... 383/33; 248/99; 141/108; 294/55; 150/51; 220/1 T; 220/404

[58] Field of Search ..... 383/33, 127, 909; 294/55, 56, 59; 141/108, 109, 380, 381; 248/99, 101; 150/48, 51; 224/252; 220/1 T, 254, 404

[56] References Cited

U.S. PATENT DOCUMENTS

| | | | |
|---|---|---|---|
| 121,529 | 12/1871 | Lum | 141/108 |
| D. 142,286 | 8/1943 | Mayer . | |
| 395,960 | 4/1941 | Rabey . | |
| 1,167,782 | 1/1916 | Richards | 141/108 |
| 1,266,522 | 5/1918 | Oldham | 141/108 |
| 2,462,973 | 3/1949 | Kelrick . | |
| 2,917,260 | 10/1959 | Barber et al. | 248/99 |
| 2,965,344 | 11/1957 | Baker | 248/101 |
| 3,149,809 | 9/1964 | Levy | 248/99 |
| 3,218,014 | 11/1965 | Frazier | 248/101 |
| 3,754,785 | 8/1973 | Anderson | 294/19 R |
| 3,768,763 | 10/1973 | Hembree | 248/99 |
| 3,893,649 | 7/1975 | Cornell | 248/99 |
| 4,124,185 | 11/1978 | Preisinger | 248/101 |
| 4,226,456 | 10/1980 | Barnett | 294/55 |
| 4,238,868 | 12/1980 | Sternberg | 248/101 X |
| 4,312,531 | 1/1982 | Cross | 248/99 |
| 4,357,728 | 11/1982 | Pravettone | 141/108 |
| 4,411,300 | 10/1983 | Rico | 224/252 |

FOREIGN PATENT DOCUMENTS

| | | | |
|---|---|---|---|
| 162168 | 1/1949 | Austria | 141/108 |
| 395960 | 4/1941 | Canada . | |
| 1246533 | 10/1960 | France | 248/101 |
| 1302725 | 7/1962 | France | 248/101 |
| 400890 | 4/1966 | Switzerland | 248/101 |
| 440059 | 12/1935 | United Kingdom | 141/380 |

*Primary Examiner*—Joseph Man-Fu Moy
*Assistant Examiner*—David Fidei
*Attorney, Agent, or Firm*—Knobbe, Martens, Olson & Bear

[57] ABSTRACT

An article receptacle for the disposal of articles, such as trash and litter, includes a flexible bag frictionally retained between two frames. The frames nest together to permit the bag to be inserted and removed without bending or deforming the frames, and to permit the frictional engagement of the frames to strengthen in response to the bag load. Several attachments provide support for the assembled frames: a hip mount supports the frames on a user's belt; a scoop attachment supports the frames in an upright position at ground level and includes a ramp to permit debris to be swept directly into the bag mouth; and a wall mount supports the frames from a vertical surface.

7 Claims, 10 Drawing Figures

Fig. 7
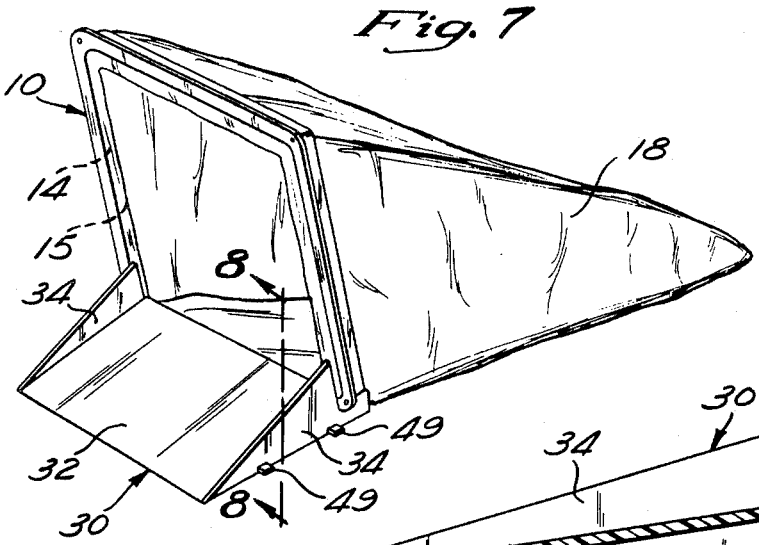
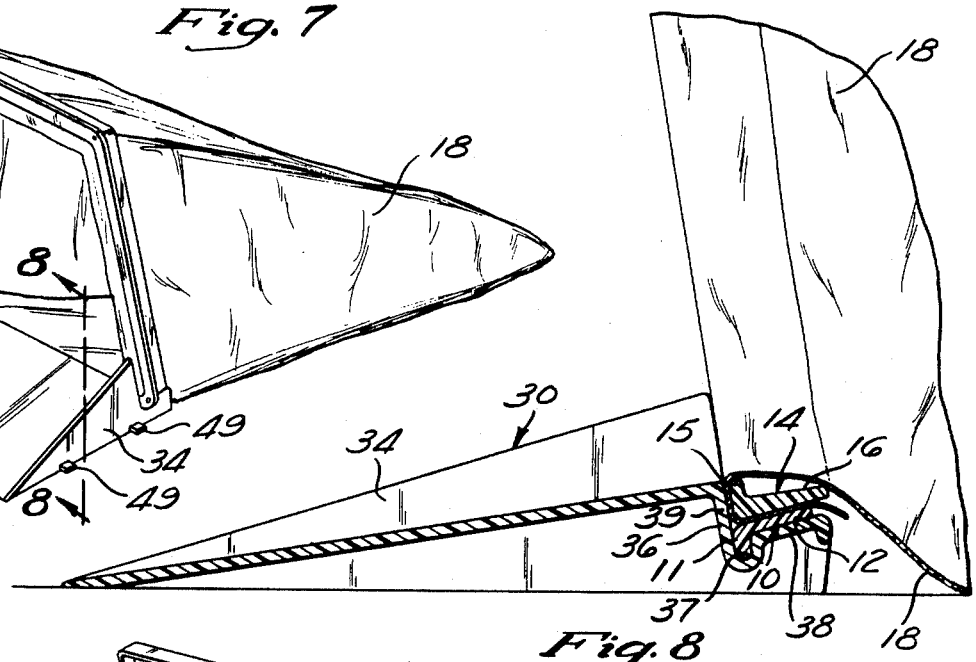
Fig. 8
Fig. 9
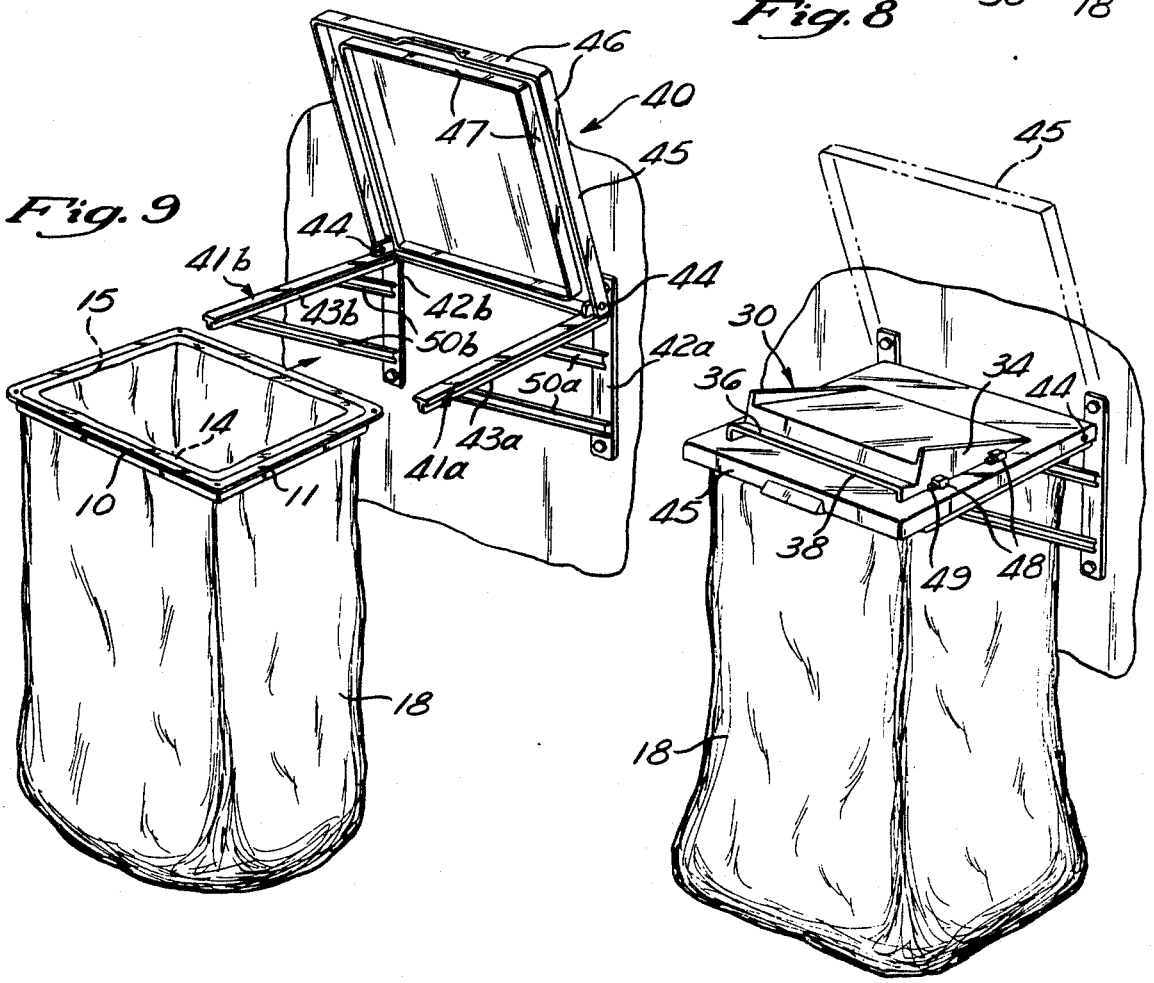
Fig. 10

ARTICLE RECEPTACLE

This application is a division of application Ser. No. 170,188, filed July 15, 1980, now U.S. Pat. No. 4,411,300.

BACKGROUND OF THE INVENTION

This invention relates generally to article receptacles and particularly to trash bag holders.

In recent years, the popularity of disposable trash bags has increased dramatically. They have proven particularly useful for disposing organic debris, such as grass clippings and the like, since the bags can be sealed after loading to prevent odors caused by decomposition of the organic material.

Nearly all disposable trash bags are now made from a thin plastic film which makes them lightweight and easy to carry. However, the plastic film is extremely pliable and flexible which makes it difficult to hold the mouth of the bag open to permit loading debris. There is, therefore, a need for a device which will hold the mouth of the disposable trash bag open and support it during loading while still retaining the portable and lightweight character of the bag.

The prior art responded to this need by providing a stand comprising a rigid frame having legs secured to a ring which receives the mouth of the bag. This addressed the problem of holding the mouth of the bag open and providing support for the bag. However, the rigid frame added a significant amount of weight and size to the bag, thereby making it cumbersome, unwiedly, and difficult to handle. Thus, the inherent lightweight and portable characteristics of the bag were lost. Further, the means used to hold the mouth of the bag open often made insertion and removal of the bag difficult and time consuming. The bag might even be torn in the process, thereby rendering it unusable.

The prior art has endeavored to overcome some of these problems by providing a frame, such as the snap-together ring disclosed by U.S. Pat. No. 3,893,649, to hold the mouth of the bag open, without supporting the frame on a stand. This restored the lightweight and portable characteristics of the bag while providing means for holding the mouth of the bag open. However, in doing so, the problem of providing support for the bag was recreated and remains unresolved. For example, the aforesaid U.S. Pat. No. 3,893,649 teaches that the bag must be supported by holding the ring-like frame in one hand while loading the bag with the other hand. This method of support is obviously awkward and unsatisfactory, since it is apparent that the user's hand would tire easily from holding the frame in such position. Further, said patent teaches that the frame is flexible and may be pressed against the ground so as to flatten the bottom portion to permit sweeping debris over the flattened bottom into the bag. Again, this method of loading debris is awkward since holding and pressing down on the frame will leave only one hand free to sweep such debris into the bag. Moreover, the flattened bottom of the frame will act as a barrier to prevent dust or dirt from being swept from a surface, such as a sidewalk, into the bag.

The prior art frames also have an inherent tendency to pinch the bag between the frames during installation of the bag. For example, the snap-together frames described previously comprise an outer ring frame having a circular cross section and an inner ring frame having an outwardly disposed U-shaped cross section. The outer frame is sized to fit within the resilient U-shaped channel of the inner frame. Thus, when the frames are assembled, sufficient pressure must be applied to force the outer frame over the edge of the inner frame. Since the bag is between the frames, such pressure will pinch the bag, thereby weakening the bag wall or perhaps tearing it. Similar problems may be encountered with prior art frames that are hinged together. For example, these frames may require that the periphery of the bag mouth be torn or notched to clear the hinges. Further, since the hinged frames inherently require that the inner and outer frames be fitted together at an angle with respect to each other, the frames may pinch the bag wall therebetween as the hinges are closed.

SUMMARY OF THE INVENTION

The present invention alleviates these and other difficulties of the prior art by providing an independent pair of square or rectangular frames adapted to hold the mouth of a trash bag frictionally therebetween. The frames, with the bag attached, may be supported by several attachments. A hip mount attachment provides means for supporting the frames on the hip of the user. The frames may also be semi-permanently mounted in a wall mount attachment. In addition, a scoop attachment is provided to hold the frames in a vertical, free-standing position on the ground, thereby facilitating the loading of debris onto the scoop and into the mouth of the bag. Thus, the frames, with attachments provide means for holding the mouth of the bag open, and means for supporting the bag, without compromising the bag's inherent lightweight and portable characteristics.

In the preferred embodiment, the inner frame and the outer frame are completely independent of each other. The inner frame is sized to have a perimeter length approximately equal to the circumference of the mouth of the bag, so that the mouth may be inserted through and folded over the inner frame throughout the bag mouth circumference. The outer frame is sized to permit the inner frame to fit within it. Each of the two frames is comprised of a inverted L-shaped channel formed by a respective top leg and a respective side leg. The top and side legs of the inner frame channel form an acute angle, and the top and side legs of the outer frame channel form an obtuse angle, with such obtuse and acute angles being supplements of each other. The channels are shaped so that, when the inner frame is inserted into the outer frame, the side legs of the respective frame channels nest together and their top legs align with each other. Thus, by wrapping the bag mouth over the inner frame in the aforementioned manner, and inserting the inner frame into the outer frame, the respective side legs of the frame channels will hold the bag therebetween.

When the bag is loaded, the tensile forces created on the bag walls will force the inner frame downward with respect to the outer frame. However, the acute and obtuse angles of the respective frame channels will prevent the inner frame from sliding below the outer frame. Thus, such downward force on the inner frame will be applied against the outer frame, thereby enhancing the frictional engagement between the two frames.

Means for disengaging the frames is provided by making the side leg of the inner frame channel slightly longer than that of the outer frame. By pressing upward on the bottom of such inner frame channel, the inner frame will slide above the outer frame, thereby disengaging the frames and permitting the bag to be removed.

Such means for engaging and disengaging the frames permits the bag to be installed and removed without bending or deforming the frames. The complete independence of the frames, and lack of positive locking devices or hinges, prevents the thin bag wall from being pinched between the frames during installation, and thus, protects the bag against tearing. Further, by folding the bag over the inner frame in the manner described, the weight of the bag load will be applied to the side legs of the frame channels to enhance the frictional engagement of the bag with the frames. Thus, the present invention permits the degree of such frictional engagement to vary in response to the bag load. This provides further protection against bag tears, since for a given bag load, the force applied by the frames to the bag will be limited to that reasonably necessary to hold the bag in place.

After the bag has been inserted between the frames in the foregoing manner, the frames may be supported on the hip of the user by means of a hip mount. The hip mount is essentially an S-shaped bracket, comprised of two opposing hooks, the first of which is inserted downwardly and sized to fit snugly, on the user's belt, while the second receives one side of the assembled frames. The second of the two hooks is sized to permit the frames to pivot freely about the hip without tearing the bag. The side leg of the inner frame is notched at the point where the frames are received by the hip mount to prevent the frames from sliding on it and to assure that the hip mount will not disengage the frames from one another.

Since the weight of the frames will cause them to hang vertically from the hip mount, the mouth of the bag is normally closed. However, the user may open the mouth of the bag simply by grasping the side of the frames opposite the pivotal support and raising that side of the frames until the bag mouth is fully open. The bag mouth may be similarly opened by attaching a strap or cord to the side of the frames opposite the hip mount to form a sling which may be supported by the user's shoulder.

Thus, by providing support for the frames, the hip mount eliminates the awkwardness and discomfort associated with holding the bag mouth open by supporting the entire frame with one hand. Further, by allowing the frames to pivot about the hip mount, the bag mouth may be closed to provide the user respite against odors or insects eminating from the bag. In addition, such pivot provides the user increased maneuverability since the frames can be pivoted out of the way to permit passage through doorways or other narrow openings. The hip mount also enables the user to use both hands to pick up debris without dropping the bag to the ground.

A wall mount is included to provide semi-permanent support for the assembled frames. The wall mount comprises a pair of brackets attached to a wall and extending perpendicularly from the wall. The brackets are sized and positioned to form a U-shaped opening into which the frames may be inserted, or from which the frames may be removed, without lifting the bag over the brackets.

The wall mount is preferably mounted at a height equal to or slightly less than the height of the bag, to permit the bottom of the bag to rest on the ground. Thus, when the bag is loaded, most of the weight of the load will be borne by the ground rather than by the bag. Positioning the wall mount in such manner, therefore, protects the bag wall against tensile forces which might tear the bag and reduces stress on the wall mount and frames. Further, whatever weight is borne by the bag will serve to increase the frictional engagement of the bag with the frames, in the manner previously described, thereby preventing the bag from slipping out of the frames.

The wall mount is sized to support only the top leg of the outer frame channel. Since the side leg of the inner frame channel extends below that of the outer frame channel, the frames may be disengaged by pushing upward on the bottom of such side leg. This permits the bag to be removed directly from the wall mount without sliding it along the ground, thereby reducing the risk of tearing the bag.

The wall mount has numerous alternative applications. For example, it may be mounted on a laundry cart, such as those used by hospitals or hotels. Laundry bags may then be inserted and retained between the frames, and the frames may be supported by the wall mount in the same manner as described for trash bags. The frames and wall mount may also be adapted to hold litter bags for use in the home or car. Additional applications of the present invention will be apparent to those skilled in the art.

The present invention also includes a scoop to facilitate loading debris directly from the ground into the mouth of the bag. The scoop comprises an inclined ramp having a bracket at its high end. The bracket is contoured to hold the assembled frames, and thus the mouth of the bag, in an essentially vertical position with respect to the ground. Such vertical position is slightly inclined towards the scoop to provide stability. The scoop has side edges which align with and support the inner frame. Thus, such side edges cooperate with the bracket to hold the frames together, and thereby enhance the frictional engagement of the frames with the bag.

Since the scoop, rather than the user, holds the frames in position, the user has both hands available to sweep debris. Further, in contrast to the flexible circular frames, there is no need to flatten the bottom portion of the frames by pressing down on them to permit sweeping over the flattened bottom into the bag, because the bottom of a rectangular frame is inherently flat. Moreover, there is no need to sweep debris over the frames, since the scoop includes a ramp to permit debris to traverse the frames.

From the foregoing, it can be seen that the frames cooperate with the hip mount, wall mount and scoop attachments to provide the flexibility necessary to respond to most any debris loading situation. The frames are independent of the attachments, and thus, can be used separately or with any of the attachments without disengaging the bag from the frames. For example, the user may begin a job by loading a pile of debris directly from the ground without the use of any attachments. He might then engage the frames in the hip mount and walk an area to gather litter. After sweeping a sidewalk, the scoop might then be attached to the frames to facilitate loading the sweepings into the bag. The frames might then be inserted into the wall mount so that grass clippings from a mower grass catcher could be loaded. In such manner, the user can choose the attachment that best fits the work to be done, and he can change attachments without ever removing the bag from the pair of frames.

The frames and all of the attachments, with the exception of the wall mount, are lightweight and portable. Thus, they can be easily moved to and from the job site. Further, they do not compromise the inherent lightweight qualities which have helped make disposable plastic trash bags so popular.

DESCRIPTION OF THE DRAWINGS

These and other advantages of the present invention are best understood through reference to the drawings, in which:

FIG. 7 is a perspective view of the frames, with the bag attached, being held in position by the scoop;

FIG. 8 is a cross-sectional view taken along lines 8—8 of FIG. 7 showing the U-shaped channel of the scoop engaging the frames;

FIG. 9 is a perspective view of the frames, with the bag attached, and the wall mount, prior to insertion of the frames into the wall mount; and FIG. 10 is a perspective view of the frames, with the bag attached, after insertion in the wall mount, illustrating the scoop in its stored position.

DETAILED DESCRIPTION

Figure 1:
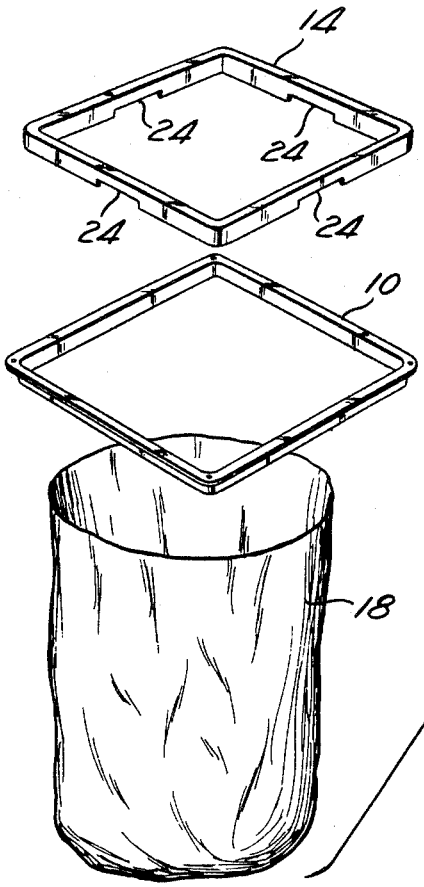
FIG. 1 is an exploded perspective view showing the inner and outer frames and the trash bag.
Figure 2:
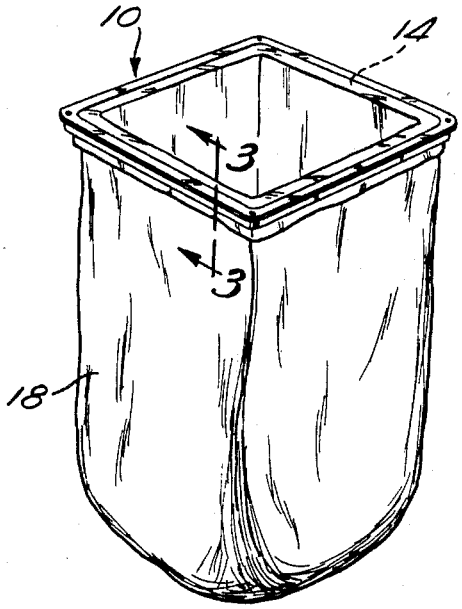
FIG. 2 is a perspective view of the bag retained between the two frames.

Referring initially to FIG. 1, the invention includes an independent pair of square or rectangular frames 10, 14. The inner frame 14 is sized to permit the mouth of a bag 18 to be inserted through and folded over it. The bag 18 may, for example, be a trash bag of at least a 15 gallon capacity. The outer frame 10 lies generally in a second plane and is sized to permit the inner frame 14 to fit within it. The two frames 10, 14 nest to hold the bag 18 therebetween, as shown in FIG. 2.

Figure 3:
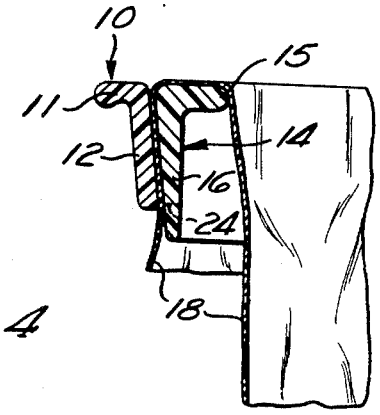
FIG. 3 is a partial cross-sectional view taken along the lines 3—3 of FIG. 2 showing the bag being frictionally retained between the frames.

Referring to FIG. 3, each of the frames 10, 14 are comprised of inverted L-shaped channels formed by respective top legs 11 and 15 which extend in the planes of the frames 10, 14, and respective side legs 12 and 16. The top leg 11 and side leg 12 of the outer frame channel 10 join to form an obtuse angle, while the top leg 15 and side leg 16 of the inner frame channel 14 join to form an acute angle. The acute angle of the inner frame 14 and the obtuse angle of the outer frame 10 are supplements of each other; that is, they add to 180°. Thus, when the inner frame 14 is inserted into the outer frame 10, the side leg 16 will nest in the side leg 12, while the oppositely extending top legs 11, 15 will align with each other. Therefore, when the bag 18 is inserted through and folded over the inner frame 14 and the inner frame 14 is then inserted downwardly into the outer frame 10, the bag 18 will be frictionally retained between the nesting side legs 12 and 16.

As debris is loaded into the bag 18, such debris will create tensile forces along the bag walls. Since the bag 18 is folded over the inner frame 14, these forces will tend to pull the inner frame 14 downward with respect to the outer frame 10. However, since the inner frame 14 cannot slide below the outer frame 10 because of the angular relationship between the side legs 12 and 16, the weight of such debris will force the side leg 16 against the side leg 12. Thus, the frictional engagement between the frames 10, 14 will automatically increase in proportion to the weight of the bag load to prevent the bag 18 from slipping between the frames 10, 14.

The side leg 16 of the inner frame 14 is sized to extend slightly below the side leg 12 of the outer frame 10. The frames 10, 14, therefore, may be disengaged to permit removal of the bag 18 simply by pushing upward on the bottom of the side leg 16.

Figure 4:
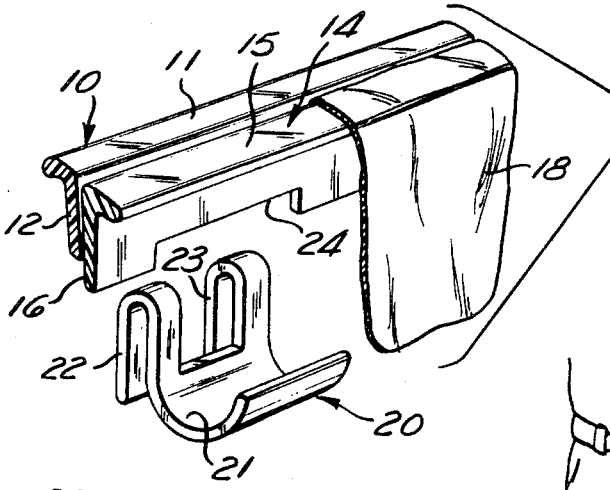
FIG. 4 is a perspective view of the hip mount, exploded from a partial perspective view of the frames, illustrating the notched inner frame.

Referring to FIG. 4, the present invention includes a hip mount 20. The hip mount 20 is comprised of a U-shaped channel 21 having hooks 22 and 23 extending from each end. The hooks 22, 23 are sized to slide downwardly on the user's belt and fit snugly on it, while the channel 21 is sized to permit the frames 10, 14 to fit within it. The channel 21 receives the frames 10, 14 at a notch 24 in the inner frame 14. The depth of the notch 24 is equal to the difference in length between the side legs 12 and 16 of the frames 10, 14, and its length is slightly longer than that of the hip mount channel 21. Thus, the notch 24 permits the channel 21 of the hip mount 20 to support both frames 10, 14, and prevents the frames 10, 14 from sliding along the channel 21. Preferably, the frame 14 has a notch 24 centered in all of its sides to permit any side of the assembled frames 10, 14 to be inserted into the hip mount 20 (see FIG. 1).

Figure 5:
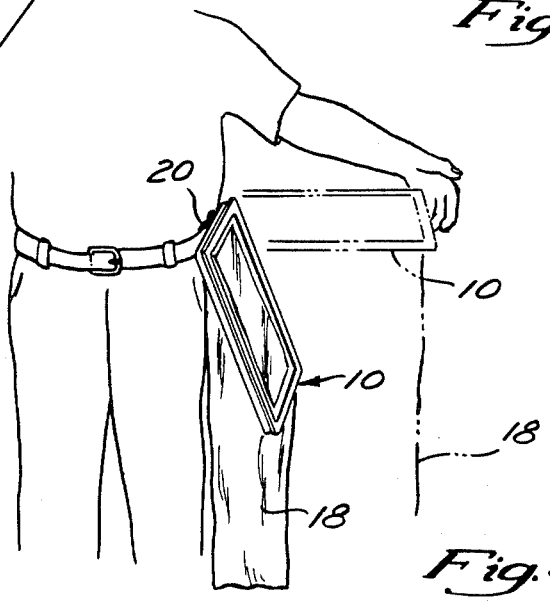
FIG. 5 is a perspective view of the frames, with the bag attached, being supported by the hip mount.

The channel 21 is semi-circular to permit the frames 10, 14 to pivot freely within it. Thus, the bag mouth may be closed by pivoting the frames 10, 14 downward so that they are parallel to the side of the user, as shown in FIG. 5. The bag mouth may be opened by grasping the side of the frames 10, 14 opposite the hip mount 20 and pivoting them upward so that the bag mouth is horizontal, as shown in phantom in FIG. 5. A shoulder strap or sling (not shown) may be included to provide an alternative means of support for the side of the frames 10, 14 opposite the hip mount 20 to permit free use of both hands.

Figure 6:
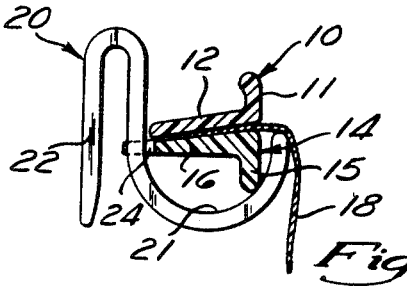
FIG. 6 is an elevation view of the hip mount, with the frames being shown in cross-section.

Referring now to FIG. 6, the depth of the hip mount channel 21 and the size of the frames 10, 14 are chosen to permit the frames 10, 14 to pivot freely in the hip mount 20 without tearing the bag 18. Thus, assuming that the frames 10, 14 are positioned so that the bag mouth is in its closed position, as shown in FIG. 6, the top leg 15 of the inner frame 14 is of sufficient length to permit the bag 18 to pass over the channel 21 without being punctured by the edge of the channel 21. The side legs 12, 16 are of sufficient length to permit the point at which the bag 18 enters the frames 10, 14 to be relatively close to the edge of the channel 21. However, such side legs 12, 16 are not so long that they will prevent the frames 10, 14 from pivoting within the channel 21. Assuming that the frames 10, 14 are now rotated to open the mouth of the bag, the side legs 12, 16 will slide and pivot to align with the bottom of the channel 21. The top leg 11 of the outer frame 10, therefore, is sized so that it is sufficiently short to permit such rotation. Thus, the dimensions of the frames 10, 14 and the hip mount channel 21 are chosen to permit the frames 10, 14 to pivot in the hip mount 20 while preventing damage to the bag 18.

Referring to FIG. 7, a scoop 30 is provided to retain the assembled frames 10, 14 in an essentially vertical position in order to facilitate loading debris directly from the ground into the mouth of the bag 18. The scoop 30 comprises a ramp 32 to permit debris to traverse the frames 10, 14, and side edges 34 to guide the debris into the bag mouth. Referring to FIG. 8, the scoop 30 also includes a bracket 36 at one end thereof, the bracket 36 being adapted to engage one side of the nested frames 10, 14 and hold the frames 10, 14 in a plane which is at an angle of approximately 10° from the vertical to permit them to be inclined slightly towards the ramp 32 of scoop 30. Such inclination places the center of gravity of the frames 10, 14 at a location which is laterally displaced from the bracket 36 and directly above and over the scoop 30, thereby providing stability to prevent the scoop 30 and frames 10, 14 from falling over. The bracket 36 includes a U-shaped channel 37 which receives the top leg 11 of the outer frame 10 and a flange 38 which supports the side leg 12 of the outer frame 10. The top leg 15 of the inner frame 14 is supported by a shoulder 39 extending above the U-shaped channel 37, which also serves to join the bracket 36 with the ramp 32. Thus, the bracket 36 provides support for the frames 10, 14 to retain them in an upright position. Referring back to FIG. 7, the side edges 34 provide support for the top leg 15 of the two vertically disposed channels of the inner frame 14, and thereby strengthen the engagement of the frames 10, 14 at the bracket 36. Thus, the side edges 34 and the bracket 36 cooperate to hold the frames together in an upright, but inclined, position.

The assembled frames may be semi-permanently mounted by inserting them into a wall mount 40, as shown in FIG. 9. The wall mount 40 is comprised of a pair of brackets 41(*a*) and 41(*b*). The brackets 41(*a*) and 41(*b*) are comprised of respective first legs 42(*a*) and 42(*b*), which are connected at right angles to respective second legs 43(*a*) and 43(*b*). Diagonal braces 50(*a*), 50(*b*) provide strength for the brackets 41(*a*), 41(*b*), respectively. The first legs 42 of the respective brackets 41 are attached to a vertical surface, such as a wall, while the second legs 43 of the respective brackets 41 extend perpendicularly from the wall. The brackets 41 are positioned so that their respective second legs 43 lie in a horizontal plane, and are spaced to permit the second legs 43 to receive and support the assembled frames 10, 14. Thus, the second legs 43 and the wall form a U-shaped opening into which the frames 10, 14 may be inserted without lifting the bag 18 over the brackets 14. Further, the second legs 43 are sized to support only the top leg 11 (FIG. 3) of the outer frame 10. This permits the inner frame 14 to be supported solely by nesting in the outer frame 10, and, therefore, the inner frame 14 is not in direct contact with the second legs 43 of the respective brackets 41. Thus, the bag 18 may be disengaged from the frames 10, 14, without removing such frames from the wall mount 40 by pushing upward on the bottom of the elongated side leg 16 (FIG. 3) of the inner frame 14. Such disengagement permits the bag 18 to be removed from the wall mount 40 without lifting it or sliding it along the ground.

The wall mount 40 includes a lid 45, pivotally attached to the brackets 41 by hinges 44. The hinges 44 may be mounted on the brackets 41(*a*) and 41(*b*) respectively, as shown in FIG. 9, or they may both be mounted on one or the other of the brackets 41 to allow the lid to pivot sideways. A lip 46 extends from the perimeter of the lid 45. Within the lip 46, a flange 47, sized to be congruent with the inner frame 14, is provided on the bottom of the lid 45. When the lid 45 is closed, the flange 47 aligns with the top leg 15 (FIG. 3) of the inner frame 14 to seal the mouth of the bag 18. Such seal prevents moisture or insects from entering the bag 18 and controls odors eminating from the bag 18.

Referring to FIG. 10, the wall mount 40 is positioned on the wall, or other surface, at a height slightly less than the height of the bag 18 to permit the bottom of the bag 18 to rest on the ground. Thus, the weight of any debris in the bag 18 will be borne primarily by the ground, rather than by the wall mount 40. This protects the bag against tearing and reduces stresses on the brackets 41 and frames 10, 14. However, since the brackets 41 support only the outer frame 10, any weight borne by the bag 18 will serve to increase the frictional engagement between the frames 10, 14, in the manner previously described, to prevent the bag 18 from slipping between the frames 10, 14.

Four hooks 48 (two of which are shown) are provided on the lid 45 to permit the scoop 30 to be stored on the lid 45. The side edges 34 of the scoop 30 have four perpendicularly disposed projections 49 which slide under the four hooks 48, respectively. Thus, the hooks 48 cooperate with the projections 49 to retain the scoop 30 on the lid 45. The bracket 36 of the scoop 30 provides a convenient handle to raise the lid 45 as shown in phantom in FIG. 10. The scoop 30 may be disengaged from the lid 45 by sliding it along the lid 45 until the projections 49 clear the hooks 48. It may then be used in combination with the frames 10, 14, as previously described in reference to FIG. 7, or it may be turned upside down and used as a dust pan with the bracket 36, again providing a convenient handle.

What is claimed is:

1. An article receptacle, comprising:

an inner frame, having an opening for receiving the mouth of a flexible bag, said inner frame having a top leg and a side leg;

an outer frame, independent of said inner frame, said outer frame having a top leg and a side leg, said inner and outer frames being formed to nest together to permit said inner frame to be freely and easily removed from said outer frame by lifting said inner frame out of said outer frame, and permit said inner and outer frames to frictionally engage said bag therebetween by lowering said inner frame into said outer frame; and a scoop attachment, independent of said frames, comprising:

a ramp;

a bracket, attached to said ramp, for holding said frames, said bracket including (1) a channel for receiving the top leg of said outer frame, (2) a flange for supporting the side leg of said outer frame, and (3) a shoulder for supporting the top leg of said inner frame, said channel, said flange, and said shoulder cooperating to engage said frame to retain said frames a free standing position on said scoop attachment with said inner and outer frames nested together.

2. An article receptacle, as defined in claim 1, wherein said ramp includes side edges to guide debris into the bag mouth, said side edges cooperating with said bracket to hold said frames in said position.

3. An article receptacle, as defined in claim 1, wherein said bracket is adapted to hold said frames to lie in a plane which is inclined from the vertical towards said ramp to place the center of gravity of said frames over said ramp.

4. An article receptacle, comprising:

a flexible bag;

an inner frame, sized to permit the mouth of said bag to be inserted through and folded over said inner frame, said inner frame lying in a first plane and comprising a first channel having a top leg and a side leg, said first channel top leg being parallel to said first plane and said first channel side leg forming an acute angle with said first channel top leg;

an outer frame, independent of said inner frame, said outer frame lying in a second plane and comprising a second channel having a top leg and a side leg, said second channel top leg being parallel to said second plane, and said second channel side forming an obtuse angle with said second channel top leg;

said acute and obtuse angles being supplements of each other;

said outer frame being sized, and said inner and outer frames being formed to nest together to permit said inner frame to be freely and easily removed from said outer frame by lifting said inner frame out of said outer frame, and permit said inner and outer frames to frictionally engage said bag therebetween by lowering said inner frame into said outer frame; and a scoop attachment comprising:

a channel having two legs shaped to form a U, with one of said legs being longer than the other, said U-shaped channel being sized to permit said top leg of said outer frame channel to be retained by said U-shaped channel;

a flange, connected to the end of the shorter of said U-shaped channel legs, and disposed outwardly from said U-shaped channel at said obtuse angle to permit said flange to support said side leg of said outer frame channel, said longer U-shaped channel leg being sized to support said top leg of said inner frame; and a ramp, connected to the end of said longer U-shaped channel leg throughout the length of said U-shaped channel at an angle which permits said U-shaped channel to retain said frames in an essentially vertical position with respect to the ground to permit debris to be swept from the ground onto said ramp and into the mouth of said bag.

5. An article receptacle, comprising:

an inner frame, having an opening for receiving the mouth of a flexible bag;

an outer frame; for mating with said inner frame to hold said flexible bag therebetween; and a scoop attachment, independent of both of said frames, for selectively engaging said frames to freestandingly hold both of said frames in a generally upright position for loading debris, said scoop attachment comprising (1) a ramp, and (2) a bracket, attached to said ramp, said bracket disposed at one end of said scoop attachment and engaging said frames at said one end of said scoop attachment, said bracket configured to hold said frames in a plane which is inclined from the vertical towards said ramp to place the center of gravity of said frames at a location which is laterally displaced from said bracket and directly above said ramp.

6. An article receptacle, comprising:

an inner frame, having an opening for receiving the mouth of a flexible bag;

an outer frame, for mating with said inner frame to hold said flexible bag therebetween, said inner and outer frames formed to nest together, such that said outer frame supports said inner frame to prevent said inner frame from passing through said outer frame, but said inner frame is freely removable by lifting said inner frame relative to said outer frame;

a lid for closing the opening formed by said frames; and a scoop attachment, independent of said frames, for selectively engaging said frames to freestandingly hold said frames in a generally upright nested position for loading debris, said scoop attachment comprising (1) a ramp, and (2) a bracket, attached to said ramp, for engaging said frames, said scoop attachment additionally comprising plural projections, sized to mate with corresponding hooks on said lid for storage of said scoop attachment on said lid.

7. An article receptacle comprising:

an inner frame, having an opening for receiving the mouth of a flexible bag;

an outer frame, for mating with said inner frame to hold said flexible bag therebetween;

a lid for closing the opening formed by said frames; and a scoop attachment, independent of both of said frames, for selectively engaging said frames to freestandingly hold both of said frames in a generally upright position for loading debris, said scoop attachment comprising (1) a ramp, and (2) a bracket attached to said ramp, said bracket including a channel for receiving said outer frame, said channel configured to retain said frames in a freestanding position on said scoop attachment at an angle relative to the vertical to incline said frames such that the center of gravity of said frames is over said ramp, said scoop attachment additionally comprising means for detachably mounting said scoop on said lid for storage.

* * * * *

UNITED STATES PATENT AND TRADEMARK OFFICE

CERTIFICATE OF CORRECTION

PATENT NO. : 4,550,440

DATED : October 29, 1985

INVENTOR(S) : Ezequiel Rico

It is certified that error appears in the above-identified patent and that said Letters Patent is hereby corrected as shown below:

Column 5, line 41, change "14 is sized" to --14 lies generally in a first plane and is sized--

Claim 5, Column 9, line 52, change "frame; for mating with" to --frame, for mating with--

Signed and Sealed this

Thirteenth Day of December, 1988

*Attest:*

DONALD J. QUIGG

*Attesting Officer*

*Commissioner of Patents and Trademarks*